US010674831B1

(12) United States Patent
Braden

(10) Patent No.: US 10,674,831 B1
(45) Date of Patent: Jun. 9, 2020

(54) MATTRESS SET LIFTING APPARATUS AND METHOD(S) OF USE THEREOF

(71) Applicant: Richard P. Braden, Lone Tree, CO (US)

(72) Inventor: Richard P. Braden, Lone Tree, CO (US)

( * ) Notice: Subject to any disclaimer, the term of this patent is extended or adjusted under 35 U.S.C. 154(b) by 0 days.

(21) Appl. No.: 16/701,358

(22) Filed: Dec. 3, 2019

(51) Int. Cl.

| | |
|---|---|
| ***A47C 19/04*** | (2006.01) |
| ***A61G 7/012*** | (2006.01) |
| ***A47C 20/04*** | (2006.01) |
| ***A47C 17/86*** | (2006.01) |

(52) U.S. Cl.
CPC ..... *A47C 19/045* (2013.01); *A61G 7/012* (2013.01); *A47C 17/86* (2013.01); *A47C 20/048* (2013.01)

(58) Field of Classification Search
CPC ..... A47C 19/05; A47C 20/048; A47C 17/86; A47C 31/00; A61G 7/012; A47B 9/10; B66F 11/00
See application file for complete search history.

(56) References Cited

U.S. PATENT DOCUMENTS

| | | | | |
|---|---|---|---|---|
| 3,742,527 | A * | 7/1973 | Johnston | A61G 7/018 5/611 |
| 2009/0044332 | A1* | 2/2009 | Parsell | A61G 7/0533 5/11 |
| 2010/0223722 | A1* | 9/2010 | Burnett | A47C 17/86 5/11 |
| 2013/0232698 | A1* | 9/2013 | Ward | A47C 21/00 5/659 |
| 2016/0022520 | A1* | 1/2016 | Streeter | A47C 27/082 5/655.3 |
| 2016/0367040 | A1* | 12/2016 | Borgman | A47C 27/18 |
| 2017/0079424 | A1* | 3/2017 | Lin | B66F 3/26 |

* cited by examiner

*Primary Examiner* — David R Hare
*Assistant Examiner* — Alexis Felix Lopez

(57) ABSTRACT

A mattress set lifting apparatus and method(s) of use thereof is described. Embodiments of the mattress set lifting apparatus include pneumatic cylinders coupled to a box spring of a mattress set. The pneumatic cylinders can be adapted to elevate a mattress set allowing a user to more easily change their sheets. After the sheets have been changed, the user can lower the mattress set back down for regular use.

17 Claims, 5 Drawing Sheets

MATTRESS SET LIFTING APPARATUS AND METHOD(S) OF USE THEREOF

BACKGROUND

Currently, to change the sheets on one's bed, the person must pick up corners of the mattress as they place the sheets onto the mattress. This requires a person to bend down and pick a corner of the mattress up, which can be heavy, to allow the sheets to be placed between the mattress and a box spring.

Elderly people with limited range of motion and lower strength often struggle to change the sheets with heavy mattresses. Injuries can occur when having to bend over and strain to pick a heavy object up.

As such, a means for elevating a mattress set to allow for an elderly person to more easily change sheets is needed.

DETAILED DESCRIPTION

Figure 1:
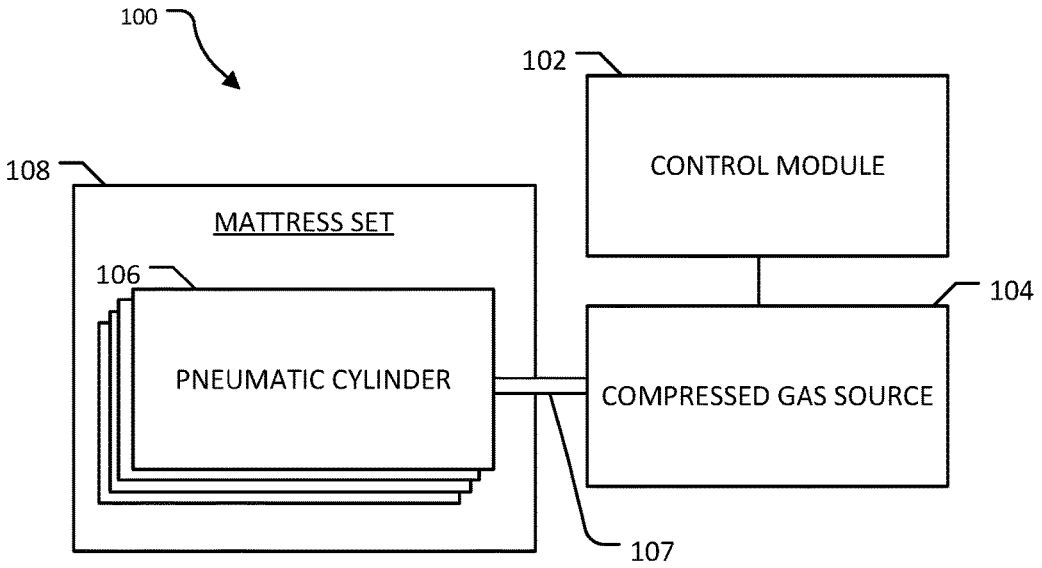
FIG. 1 is a block diagram of a mattress set lifting apparatus according to one embodiment of the present invention.

Embodiments of the present invention include a mattress set lifting apparatus and method(s) of use thereof. The mattress set lifting apparatus can be implemented to elevate and/or lower a mattress set (e.g., mattress and box springs). In a typical implementation, a user can use the mattress set lifting apparatus to raise their bed to an elevated height such that they may more easily change the sheets (or linens). Generally, the mattress set lifting apparatus can be used by those users who may be elderly or have trouble lifting heavy objects.

In one embodiment, the mattress set lifting apparatus can include, but is not limited to, a plurality of pneumatic cylinders (or actuators), a control module, and a compressed gas source. The mattress set lifting apparatus can be configured to couple to a mattress set such that the mattress set can be raised and lowered via the pneumatic cylinders. The control module can be operatively connected to each of the plurality of pneumatic cylinders. In one embodiment, the control module can be a switch for raising and lowering the pneumatic cylinders by turning the compressed gas source on or off. In some embodiments, the control module may further be operatively connected to a valve for releasing fluids from the system to lower the pneumatic cylinders. In other embodiments, the compressed gas source may be reversible such that fluid put into the system can be removed via the compressed gas source. In one instance, the compressed gas source may be a compressor.

The plurality of pneumatic cylinders can typically be placed proximate four corners of the mattress set. In some instances, additional pneumatic cylinders can be placed approximate a center of the mattress set to help lift the mattress set. In one embodiment, each of the plurality of pneumatic cylinders can include a plate that couples to the mattress set. For example, the plate can include one or more holes which can receive a fastener therethrough to couple to the mattress set. Typically, the plate can attach to a box spring of the mattress set. In some instances, the pneumatic cylinders can be implemented as a frame for the mattress set.

In one example method of use, the mattress set lifting apparatus can be implemented to aid a user in changing sheets on a bed. In a first step, the mattress set lifting apparatus can be retrofitted to a mattress set. For instance, plates located on each of the pneumatic cylinders can be coupled to the four corners of the mattress set. Once the mattress set lifting apparatus is retrofitted to the mattress set, a user can connect the pneumatic cylinders to the compressed gas source in a second step. In a third step, the user can test the control module to ensure that the pneumatic cylinders will raise and lower the mattress set. Once the apparatus has been installed, the user can lower the pneumatic cylinders to a retracted position in a fourth step. In a fifth step, the user can raise the mattress set to an elevated height. In a sixth step, the user can change sheets on the mattress while at the elevated height. In a seventh step, after the sheets have been changed, the user can lower the mattress set to a desired height.

In one embodiment, a method of using a mattress set lifting apparatus having at least four pneumatic cylinders, a compressed gas source operatively coupled to the at least four pneumatic cylinders, a control module operatively connected to the compressed gas source, a first plate coupled to each of the at least four pneumatic cylinders, and each of the plates are adapted to couple to a corner of a box spring of a mattress set can include, but is not limited to, providing the mattress set lifting apparatus, attaching the at least four pneumatic cylinders to respective corners of the box spring, using the control module of the mattress set lifting apparatus to raise and lower the bed, raising the mattress set to an elevated height, changing sheets on the mattress set while in the elevated height, and lowering the mattress set to a first height determined by a user after the sheets have been changed.

Each of the pneumatic cylinders can include, but are not limited to, (i) a bolt coupled to the first plate, (ii) a rod including a threaded bore for receiving a portion of the bolt, (iii) a second plate having a gasket, the second plate interfacing with a bottom end of the rod, (iv) a protrusion having a diameter less than a diameter of the second plate, a top of the protrusion interfacing with a bottom side of the second plate, (v) a tube adapted to house a substantial portion of the rod and an entirety of the second plate, (vi) an opening located approximate a bottom of the pneumatic cylinder, the opening for receiving gas from the compressed gas source, and (vii) a cap located proximate a top of the tube, the cap adapted to create an airtight seal on the top of the tube. In one instance, the first plate includes 5 holes where (i) a first hole is located proximate a center of the first plate, (ii) a second hole is located approximate a first corner of the first plate, (iii) a third hole is located approximate a second corner of the first plate, (iv) a fourth hole is located approximate a third corner of the first plate, and (v) a fifth hole is located approximate a fourth corner of the first plate.

The control module can include a power button, a first actionable button, and a second actionable button. The first actionable button can be operatively connected to a first timer. The first timer can be adapted to send a signal to activate the compressed gas source for a predetermined amount of time. The pneumatic cylinders can be fully extended when the compressed gas source operates for the predetermined amount of time. The second actionable button can be operatively connected to a second timer. The second timer can be adapted to send a first signal to actuate a valve to an open position for a predetermined amount of time. The pneumatic cylinders can be fully retracted when the valve is opened for the predetermined amount of time. The second timer can send a second signal to the valve to close after the predetermined amount of time has lapsed.

In another embodiment, a method of using a mattress set lifting apparatus having at least four pneumatic cylinders where each pneumatic cylinder can be coupled to a separate corner of a box spring, a compressed gas source operatively coupled to the at least four pneumatic cylinders, and a control module operatively connected to the compressed gas source can include, but is not limited to, providing the mattress set lifting apparatus where the mattress set lifting apparatus can be coupled to a box spring of a mattress set, powering on the mattress set lifting apparatus by pressing a power button on the control module, raising the mattress set to an elevated height by pressing a first actionable button on the control module, changing sheets on the mattress set while the pneumatic cylinders are at the elevated height, and lowering the mattress set after the sheets have been changed by pressing a second actionable button on the control module.

The first actionable button can be operatively connected to a first timer. The first timer can be adapted to send a signal to activate the compressed gas source for a predetermined amount of time. The at least four pneumatic cylinders can be fully extended when the compressed gas source operates for the predetermined amount of time. The second actionable button can be operatively connected to a second timer. The second timer can be adapted to send a first signal to actuate a valve to an open position for a predetermined amount of time. The at least four pneumatic cylinders are fully retracted when the valve is opened for the predetermined amount of time.

In yet another embodiment, a method of using a mattress set lifting apparatus having at least four pneumatic cylinders with each pneumatic cylinder being coupled to a separate corner of the box spring, a compressed gas source operatively coupled to the at least four pneumatic cylinders, a release valve, and a control module operatively connected to the compressed gas source and the release valve can include, but is not limited to, providing the mattress set lifting apparatus adapted to be coupled to a box spring of a mattress set, powering on the mattress set lifting apparatus by pressing a power button on the control module, raising the mattress set to an elevated height by pressing a first actionable button on the control module, changing sheets on the mattress set while the pneumatic cylinders are at the elevated height, and lowering the mattress set after the sheets have been changed by pressing a second actionable button on the control module. The release valve can be located downstream of the compressed gas source and upstream of the at least four pneumatic cylinders. The compressed gas source can include a one-way valve. The compressed gas source can operate for a predetermined amount of time when the first button is pressed. The release valve can open for a predetermined amount of time when the second actionable button is pressed.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Mattress Set Lifting Apparatus

Referring to FIG. 1, a block diagram of an embodiment 100 of a mattress set lifting apparatus is illustrated. The mattress set lifting apparatus 100 can be implemented to raise and lower a mattress set to allow a user to more easily change linens (or sheets).

As shown, the mattress set lifting apparatus 100 can include, but is not limited to, a control module 102, a compressed gas source 104, and a plurality of pneumatic cylinders 106. A tube system 107 can be implemented to fluidly connect the compressed gas source 104 to each of the pneumatic cylinders 106. The plurality of pneumatic cylinders 106 can be operatively connected to the compressed gas source 104. Typically, the compressed gas source 104 can be operatively connected to the control module 102. The control module 102 can be implemented to actuate the pneumatic cylinders 106 via the compressed gas source 104. For instance, the control module 102 can send a signal to the compressed gas source 104 to start generating compressed gas to actuate the pneumatic cylinders. In one embodiment, the compressed gas source 104 can be a compressor. Typically, the compressor may be a tankless compressor. It is to be appreciated that a variety of different types of compressors may be implemented in the present invention. The compressor 104 can typically include a one-way valve 105 (shown in FIG. 2) to allow compressed air to leave the compressor and enter a network of tubes 107 operatively connected to each of the pneumatic cylinders.

In a typical implementation, the pneumatic cylinders 106 can be actuated to elevate a mattress set 108. Once the mattress set 108 has been elevated, a user can change linens (or sheets) on the bed. As can be appreciated, when elevated, the process of changing linens can be alleviated.

Figure 2:
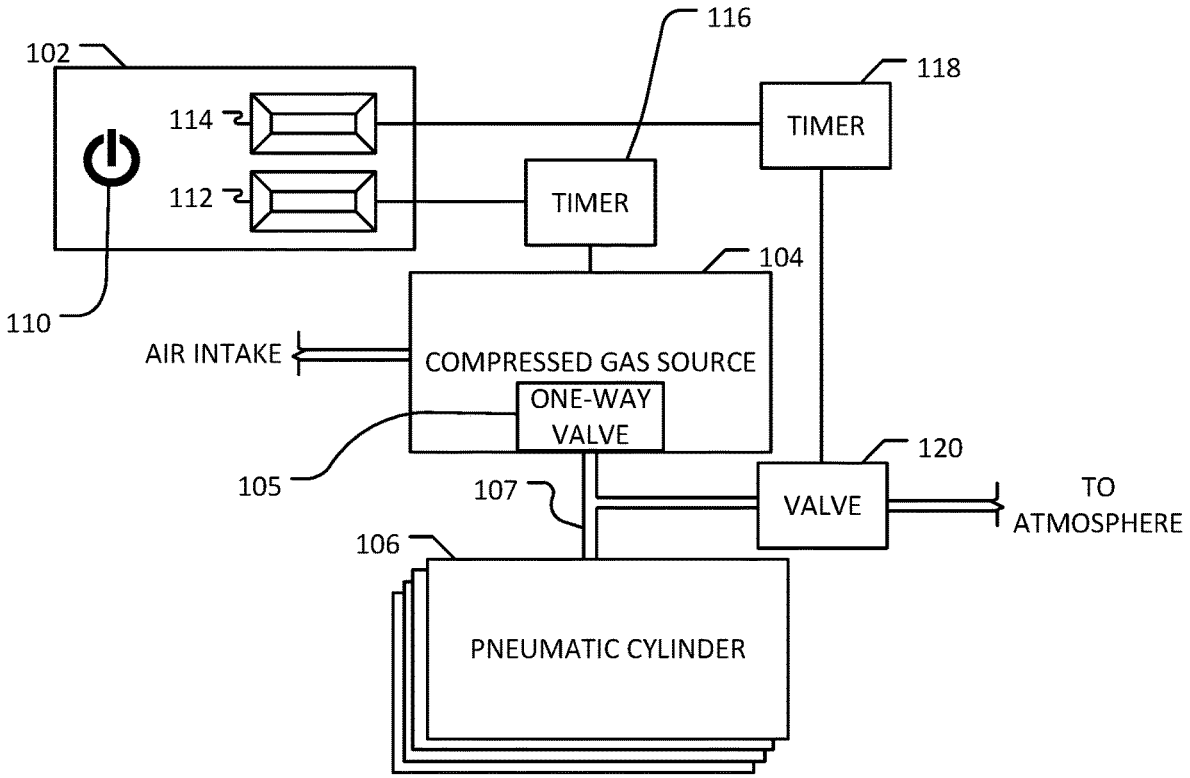
FIG. 2 is a block diagram of a mattress set lifting apparatus according to one embodiment of the present invention.

Referring to FIG. 2, one example embodiment of the mattress set lifting apparatus 100 is illustrated. As shown, the control module 102 can include a power button 110, a first actionable button 112, and a second actionable button 114. The power button 110 can be implemented to power on the components of the mattress set lifting apparatus 100. The first actionable button 112 can be connected to a first timer 116 and the compressed gas source 104. The second actionable button 114 can be connected to a second timer 118 and a valve 120. When a user presses the first actionable button 112, a signal can be sent to the first timer 116. The first timer 116 can be set for a predetermined amount of time to turn the compressed gas source 104 on. Of note, while the compressed gas source 104 is on, the pneumatic cylinders 106 can be actuated, thus raising the mattress set 108. Once the predetermined amount of time has passed on the first timer 116, the first timer 116 can send a signal to the compressed gas source 106 to stop. In some instances, this may include the compressed gas source 106 turning off. For instance, if the compressed gas source 106 includes the one-way valve 105 to keep pressure in the tube system 107, the pneumatic cylinders 106 may remain elevated even when the compressed gas source 104 is turned off. The valve 120 can be set to a closed position while the compressed gas source 104 is powered on.

Figure 3:
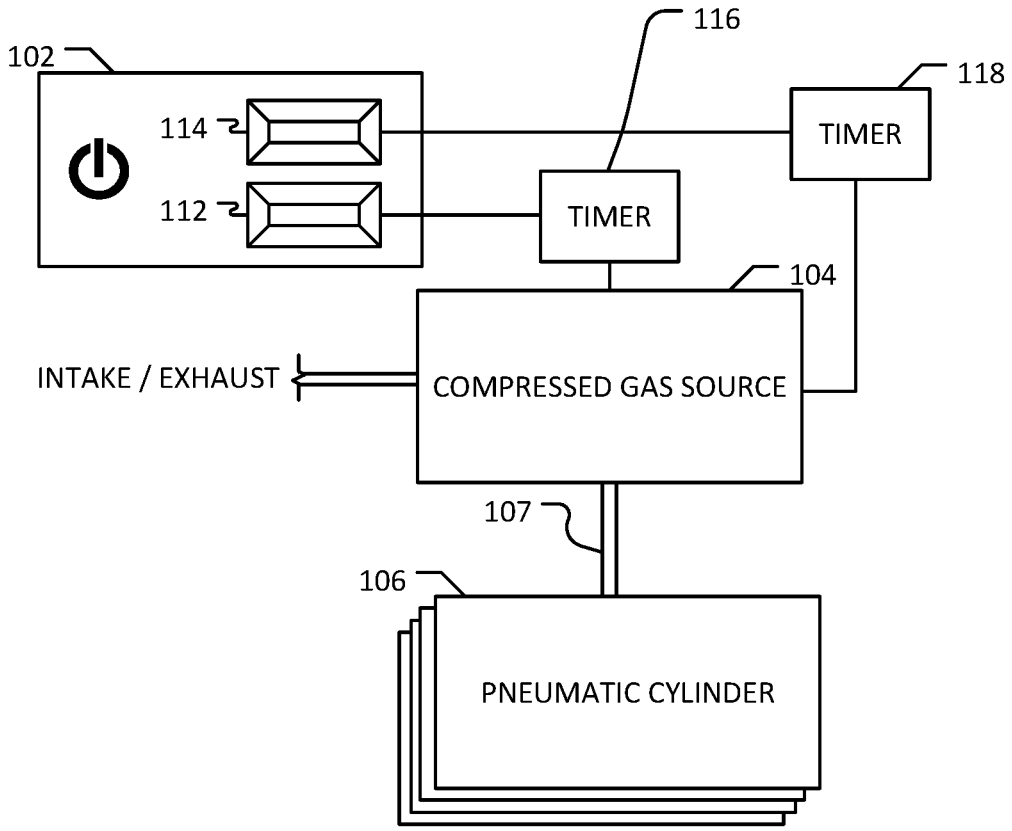
FIG. 3 is a block diagram of a mattress set lifting apparatus according to one embodiment of the present invention.

Referring to FIG. 3, another example embodiment of the mattress set lifting apparatus 100 is illustrated. As shown, the control module 102 can include the power button 110, the first actionable button 112, and the second actionable button 114. The first actionable button 112 can be connected to the first timer 116. The second actionable button 114 can be connected to the second timer 118. In this example embodiment, the first actionable button 112 can be activated to send a signal to the first timer 116 which can send a signal to the compressed gas source 104 to run for a predetermined amount of time. Of note, the compressed gas source 104 can be configured to maintain pressure even after being turned off. For instance, the compressed gas source 104 may include a one-way valve to ensure compressed gas leaving stays in the network of tubes 107. The second actionable button 118 can be activated and send a signal to the second timer 118 which can then send a signal to the compressed gas source 104 to open an exhaust valve for a predetermined amount of time. In some instances, as shown, the exhaust valve may be located proximate an intake of the compressed gas source 104. In these instances, when the compressed gas source 104 may be turned off, pressurized gas in the network of tubes 107 can be released as a valve is opened for a predetermined amount of time determined by the second timer 118. In other instances, an exhaust valve may be located downstream of the one-way valve in the compressed gas source 104, thus allowing pressurized gas to be released when opened. In some embodiments, each of the pneumatic cylinders 104 may include a release valve for releasing pressure in the cylinders.

Figure 4A:
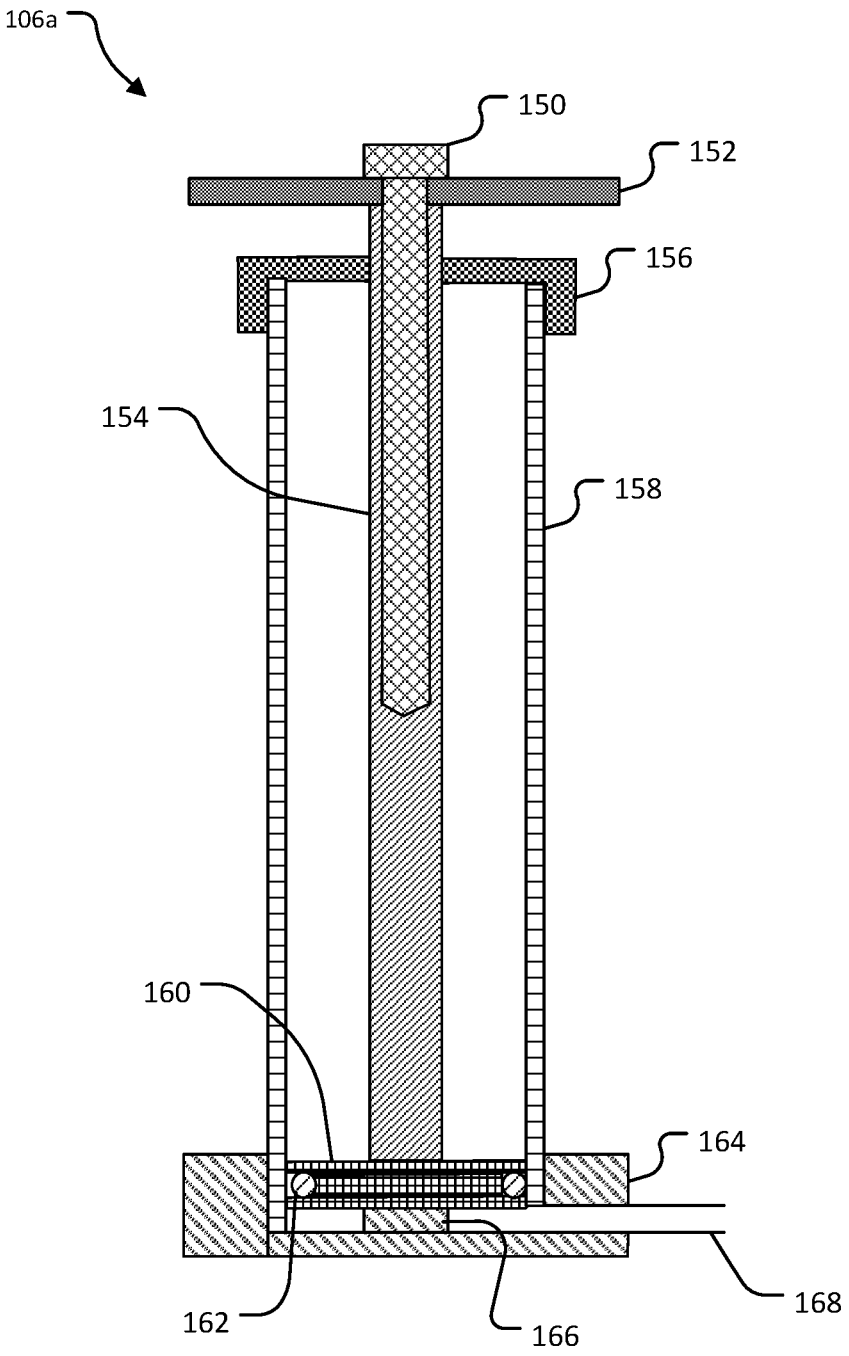
FIG. 4A is a cross-sectional view of a first example pneumatic cylinder according to one embodiment of the present invention.
Figure 4B:
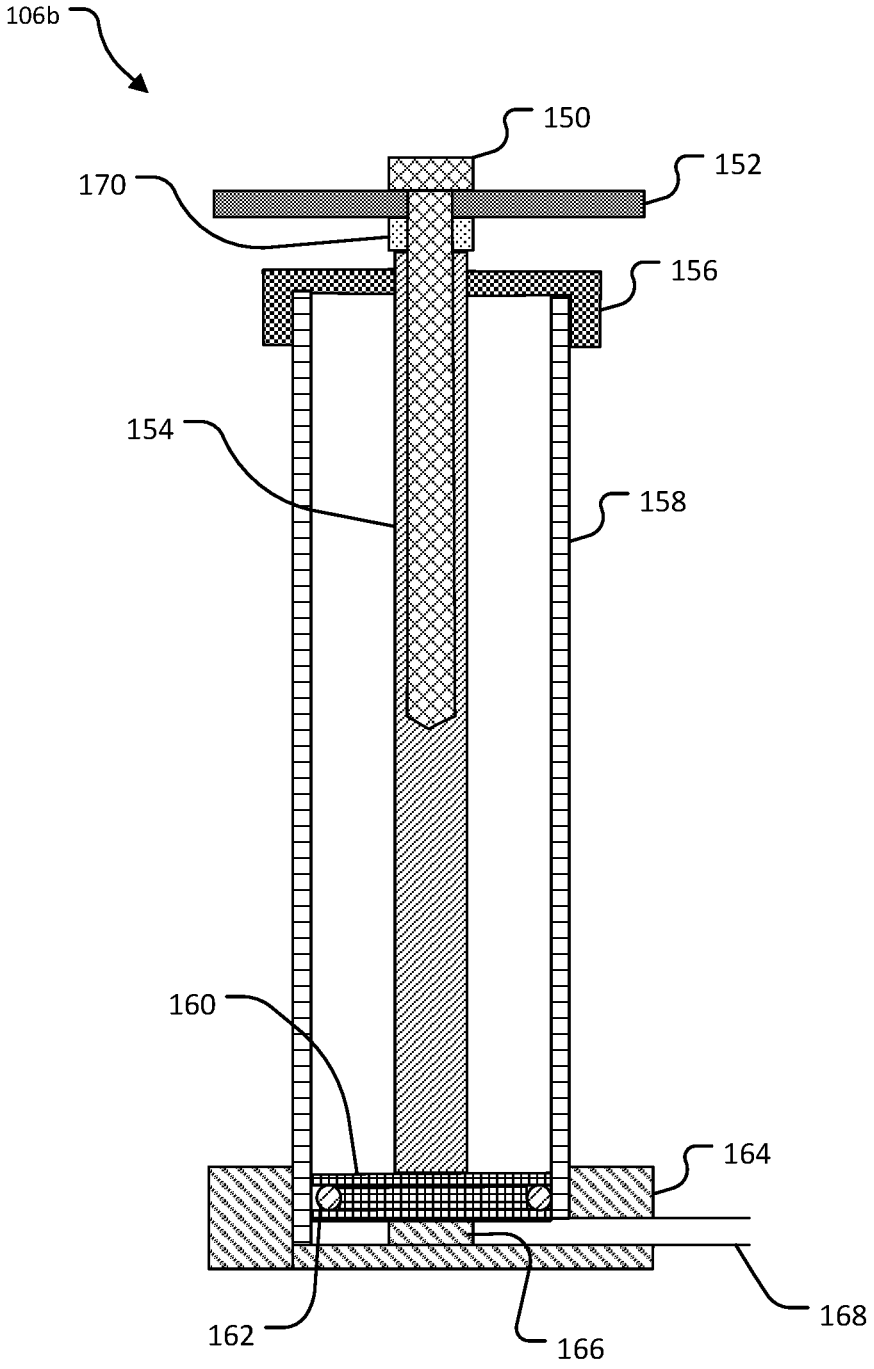
FIG. 4B is a cross-sectional view of a second example pneumatic cylinder according to one embodiment of the present invention.

Referring to FIGS. 4A-4B, detailed diagrams of example embodiments of pneumatic cylinders 106 are illustrated. A first example embodiment 106*a* of a pneumatic cylinder is shown in FIG. 4A. A second example embodiment 106*b* of a pneumatic cylinder is shown in FIG. 4B. The components of the first example pneumatic cylinder 106*a* can be substantially similar to the components of the second example pneumatic cylinder 106*b*.

As shown, the first example pneumatic cylinder 106*a* can include, but is not limited to, a bolt 150, an attachment plate 152, a rod 154, a cap 156, a tube 158, a plate 160, a gasket 162, a base member 164, a spacer 166, and an intake 168. In one embodiment, the bolt 150 can be threadably coupled to the attachment plate 152 and the rod 154. In another embodiment, the bolt 150 may be adhesively coupled (e.g., chemically bonded) to the attachment plate 152 and threadably coupled to the rod 154. In yet another embodiment, the bolt 150 may be welded to the attachment plate 152 and threadably coupled to the rod 154. The rod 154 may include a threaded bore sized to receive the bolt 150 therein. Of note, by providing the threaded bore, a height of the attachment plate 152 in relation to a floor can be vertically adjusted based on a particular height of a mattress set. In some instances, a user may wish to raise a height of the attachment plate 152 such that the mattress set rests at a greater height when the plate 160 is in a fully lowered position. The rod 154 can typically extend down to the plate 160. The cap 156 can be implemented to provide an airtight seal for a top of the tube 158. The plate 160 can include the gasket 162 to provide an airtight seal between a bottom of the plate 160 and a top of the base member 164. When the compressed gas source 104 is activated and compressed gas is provided to the pneumatic cylinder 106*a* via the intake 168, the plate 160 can be moved upwardly as the compressed gas forces the plate 160 to move. The gasket 162 can help to ensure that no gas is leaked into open space above the plate 160. The base member 164 can be implemented as a support member for the components of the pneumatic cylinder 106*a*. the spacer 166 can be implemented as means to ensure that the plate 160 does not lower down past the intake 168 of the pneumatic cylinder 106*a*. As can be appreciated, if the plate 160 were allowed to be lowered down fully, the compressed gas may not elevate the plate 160.

As shown, the second example pneumatic cylinder 106*b* can include substantially similar components as the first example pneumatic cylinder 106*a*. The second example pneumatic cylinder 106*b* can include, but is not limited to, the bolt 150, the attachment plate 152, the rod 154, the cap 156, the tube 158, the plate 160, the gasket 162, the base member 164, the spacer 166, the intake 168, and a nut 170. The nut 170 can be implemented as a jam nut. In lieu of welding, chemically bonding, or threading the attachment plate 152 to the bolt 150, the jam nut 170 can be implemented to sandwich the attachment plate 152 between the jam nut 170 and a head of the bolt 150. The second example pneumatic cylinder 106*b* can operate substantially similar to the first example pneumatic cylinder 106*a*.

In some embodiments, the mattress set lifting apparatus 100 can implement one or more of the first example pneumatic cylinders 106*a* in combination with one or more of the second example pneumatic cylinders 106*b*.

The attachment plate 152 in the first example pneumatic cylinder 106*a* can eliminate a need for the jam nut 170 of the second example pneumatic cylinder 106*b*. Of note, the attachment plate 152 in the first example pneumatic cylinder 106*a* can reduce an overall height of the pneumatic cylinder by 0.300". As can be appreciated, this can help reduce a length of the tube 158 from 10" for the second example pneumatic cylinder 106*b* to 9" for the first example pneumatic cylinder. This can create a significant reduction in the overall height of the pneumatic cylinders 106. The decrease in overall height of the pneumatic cylinders can makes it easier for the mattress set lifting apparatus 100 to fit under more beds.

Described hereinafter are example dimensions for each of the components of the first and second example pneumatic cylinders 106*a*, 106*b*. The bolt 150 may have ½" diameter and be 5" long. A head of the bolt 150 may have 0.3" height. The attachment plate 152 may be 4.5" long by 4.5" wide by ¼" thick. The rod 154 may be approximately 10" long. A diameter of the rod 154 may be adjusted based on material used to manufacture the rod 154. For instance, the rod 154 may have a 0.75" diameter when manufactured from metal or a 1.5" diameter when manufactured from a rigid plastic. The cap 156 may be manufactured from plastic and can have a 3.5" outer diameter and be 0.75" long. In some embodiments, the cap 156 can be threadably coupled to the tube 158. The tube 158 can have a 2.5" interior diameter and be 9" long in the first example pneumatic cylinder 106*a*. The tube 158 may have a 2.5" interior diameter and be 10" long in the second example pneumatic cylinder 106*b*. The plate 160 can be approximately 2.5" wide by 0.3" high. Of note, the plate 160 can be sized to move within the tube 158 without allowing air to pass. The base member 164 may have a 4.5" outside diameter and be 1" long. The spacer 166 may be ¼" high by ¾" wide.

Figure 5A:
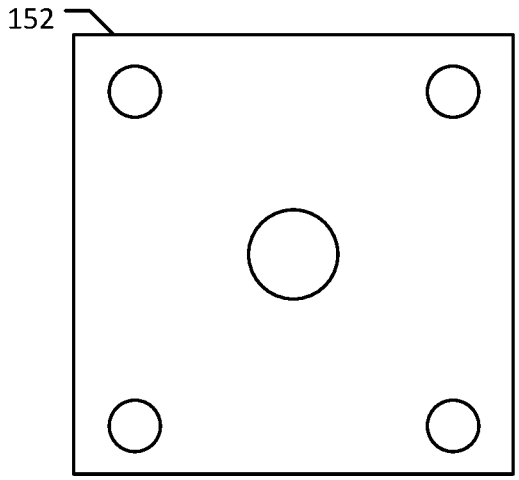
FIG. 5A is a top view of an attachment plate according to one embodiment of the present invention.

Referring to FIG. 5A, a top view of the attachment plate 152 is illustrated. In one example embodiment, the attachment plate 152 can have dimensions of 4.5" long by 4.5" wide by ¼" thick. The plate 152 can have 5 holes. A center hole for receiving the bolt 150 therethrough in addition to 4 holes for receiving fasteners therethrough. The fasteners can be implemented to secure the attachment plate 152 to a box frame of the mattress set 108. In one example, the 4 holes may be located approximate each corner of the attachment plate 152. The 4 holes may have a diameter larger than ⅛" but less than 3/16". The 4 corner holes can be approximately ⅞" from each side of the attachment plate 152 when wood of a box spring is 14/8" wide.

Figure 5B:
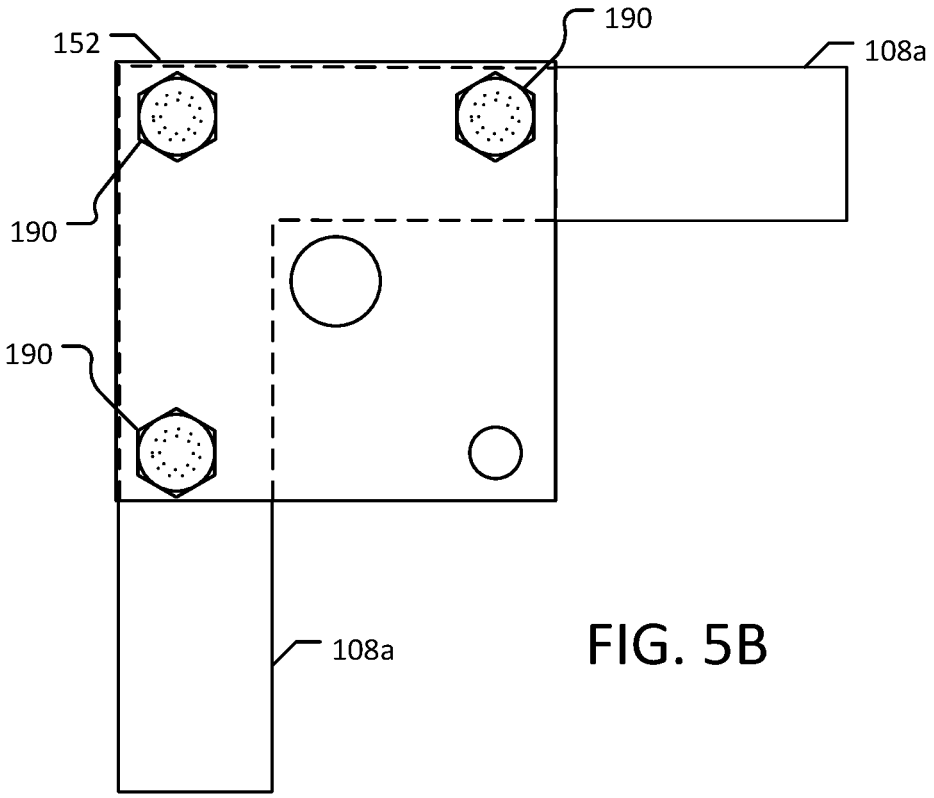
FIG. 5B is a bottom view of an attachment plate coupled to a box spring according to one embodiment of the present invention.

Referring to FIG. 5B, a bottom view of the attachment plate 152 coupled to a box spring 108*a* of the mattress set 108 is illustrated. A plurality of fasteners 190 can be implemented to couple the attachment plate 152 to the box spring 108*a*.

ALTERNATIVE EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A method of using a mattress set lifting apparatus, the method comprising:

providing a mattress set lifting apparatus, the mattress set lifting apparatus including:

at least four pneumatic cylinders;

a compressed gas source operatively coupled to the at least four pneumatic cylinders;

a control module operatively connected to the compressed gas source, the control module including a power button, a first actionable button, and a second actionable button;

a first plate coupled to each of the at least four pneumatic cylinders;

wherein (i) each of the plates are each adapted to couple to a corner of a box spring of a mattress set; and (ii) the first actionable button is operatively connected to a first timer, the first timer adapted to send a signal to activate the compressed gas source for a predetermined amount of time;

attaching the at least four pneumatic cylinders to respective corners of the box spring;

using the control module of the mattress set lifting apparatus to raise and lower the mattress set;

raising the mattress set to an elevated height;

changing sheets on the mattress set while in the elevated height; and lowering the mattress set to a first height determined by a user after the sheets have been changed.

2. The method of claim 1, wherein each of the at least four pneumatic cylinders include:

a bolt coupled to the first plate;

a rod including a threaded bore for receiving a portion of the bolt;

a second plate having a gasket, the second plate interfacing with a bottom end of the rod;

a protrusion having a diameter less than a diameter of the second plate, a top of the protrusion interfacing with a bottom side of the second plate;

a tube adapted to house a substantial portion of the rod and an entirety of the second plate;

an opening located approximate a bottom of the pneumatic cylinder, the opening for receiving gas from the compressed gas source; and a cap located proximate a top of the tube, the cap adapted to create an airtight seal on the top of the tube.

3. The method of claim 1, wherein the first plate includes 5 holes.

4. The method of claim 3, wherein (i) a first hole is located proximate a center of the first plate, (ii) a second hole is located approximate a first corner of the first plate, (iii) a third hole is located approximate a second corner of the first plate, (iv) a fourth hole is located approximate a third corner of the first plate, and (v) a fifth hole is located approximate a fourth corner of the first plate.

5. The method of claim 1, wherein the at least four pneumatic cylinders are fully extended when the compressed gas source operates for the predetermined amount of time.

6. The method of claim 1, wherein the second actionable button is operatively connected to a second timer, the second timer adapted to send a first signal to actuate a valve to an open position for a predetermined amount of time.

7. The method of claim 6, wherein the at least four pneumatic cylinders are fully retracted when the valve is opened for the predetermined amount of time.

8. The method of claim 7, wherein the second timer sends a second signal to the valve to close after the predetermined amount of time has lapsed.

9. A method of using a mattress set lifting apparatus, the method comprising:

providing a mattress set lifting apparatus, the mattress set lifting apparatus being coupled to a box spring of a mattress set and including:

at least four pneumatic cylinders, each pneumatic cylinder being coupled to a separate corner of the box spring;

a compressed gas source operatively coupled to the at least four pneumatic cylinders;

a control module operatively connected to the compressed gas source;

powering on the mattress set lifting apparatus by pressing a power button on the control module;

raising the mattress set to an elevated height by pressing a first actionable button on the control module;

wherein the first actionable button is operatively connected to a first timer, the first timer adapted to send a signal to activate the compressed gas source for a predetermined amount of time;

changing sheets on the mattress set while the pneumatic cylinders are at the elevated height; and lowering the mattress set after the sheets have been changed by pressing a second actionable button on the control module.

10. The method of claim 9, wherein the at least four pneumatic cylinders are fully extended when the compressed gas source operates for the predetermined amount of time.

11. The method of claim 9, wherein the second actionable button is operatively connected to a second timer, the second timer adapted to send a first signal to actuate a valve to an open position for a predetermined amount of time.

12. The method of claim 11, wherein the at least four pneumatic cylinders are fully retracted when the valve is opened for the predetermined amount of time.

13. A method of using a mattress set lifting apparatus, the method comprising:

providing a mattress set lifting apparatus adapted to be coupled to a box spring of a mattress set, the mattress set lifting apparatus including:

at least four pneumatic cylinders, each pneumatic cylinder being coupled to a separate corner of the box spring;

a compressed gas source operatively coupled to the at least four pneumatic cylinders;

a release valve;

a control module operatively connected to the compressed gas source and the release valve;

powering on the mattress set lifting apparatus by pressing a power button on the control module;

raising the mattress set to an elevated height by pressing a first actionable button on the control module;

wherein the first actionable button is operatively connected to a timer, the timer adapted to send a signal to activate the compressed gas source for a predetermined amount of time;

changing sheets on the mattress set while the pneumatic cylinders are at the elevated height; and lowering the mattress set after the sheets have been changed by pressing a second actionable button on the control module.

14. The method of claim 13, wherein the release valve is located downstream of the compressed gas source and upstream of the at least four pneumatic cylinders.

15. The method of claim 13, wherein the compressed gas source includes a one-way valve.

16. The method of claim 13, wherein the compressed gas source operates for the predetermined amount of time when the first actionable button is pressed.

17. The method of claim 13, wherein the release valve opens for a predetermined amount of time when the second actionable button is pressed.

* * * * *